US006759608B2

(12) United States Patent
Chu

(10) Patent No.: US 6,759,608 B2
(45) Date of Patent: Jul. 6, 2004

(54) ELECTRICAL SWITCH

(75) Inventor: Raymond Wai Hang Chu, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 0 days.

(21) Appl. No.: 10/209,928

(22) Filed: Aug. 2, 2002

(65) Prior Publication Data

US 2004/0020752 A1 Feb. 5, 2004

(51) Int. Cl.[7] ..... H01H 21/54
(52) U.S. Cl. ..... 200/16 D; 200/405; 200/6 BB
(58) Field of Search ..... 200/16 D, 6 R, 200/6 BB, 16 C, 405, 407, 424, 438, 449, 447, 558, 339

(56) References Cited

U.S. PATENT DOCUMENTS 3,857,000 A * 12/1974 Boulanger ..... 200/16 D
4,025,743 A * 5/1977 Oswald ..... 200/60
4,650,943 A * 3/1987 Boinski ..... 200/542

* cited by examiner

*Primary Examiner*—Lincoln Donovan
*Assistant Examiner*—K. Lee
(74) *Attorney, Agent, or Firm*—Leydig, Voit & Mayer, Ltd.

(57) ABSTRACT

An electrical switch comprising a casing, and at least one fixed contact and a elongate resiliently deformable movable contact member in the casing, said contact member having opposite first and second sides. The switch includes a switching member supported in sliding contact on the first side of and with intermediate parts of the contact member to cause the contact member to pivot against its resilience for making and breaking electrical connection with the fixed contacts. The contact member includes a fixed end at which it is cantilevered for pivotal movement and a trifurcated free end for contact with the fixed contacts. Resilient means is provided acting resiliently upon the second side of the contact member to maintain the sliding contact of the contact member with the switching member.

11 Claims, 8 Drawing Sheets

ELECTRICAL SWITCH

The present invention relates to a switch for controlling the operation of an electrical appliance.

BACKGROUND OF THE INVENTION

In certain types of electrical slide switches, the movable contact member is cantilevered for pivotal movement to make and break electrical connection with the fixed contact (s). For various reasons, a movable contact member of an extended length is needed, in which case the contact member may become slack after prolonged use, thereby failing to provide the necessary contact pressure. An example of this type of electrical switch is disclosed in U.S. Pat. No. 6,281,482.

The invention seeks to mitigate or at least alleviate such a problem by providing an improved electrical switch.

SUMMARY OF THE INVENTION

According to the invention, there is provided an electrical switch comprising a casing, and at least one fixed contact and a elongate resiliently deformable movable contact member in the casing, said contact member having opposite first and second sides. The switch includes a switching member supported by the casing in sliding contact on the first side of and with an intermediate part of the contact member to cause the contact member to pivot against its resilience for making and breaking electrical connection with the fixed contact. The contact member includes a fixed end at which it is cantilevered for pivotal movement and a free end for contact with the fixed contact. Resilient means is provided acting resiliently upon the second side of the contact member to maintain the sliding contact of the contact member with the switching member.

Preferably, at least two said fixed contacts are included, and the free end of the movable contact member is divided into contact prongs arranged to contact with the fixed contacts respectively.

More preferably, each contact prong includes an individual intermediate part with which the switching member is in sliding contact.

Further more preferably, the switching member includes parallel tracks, each having relatively protruding and non-protruding sections along its length, in sliding contact with the intermediate parts of the contact prongs respectively, thereby providing a number of switching combinations between the contact prongs and the fixed contacts according to the relative position of the switching member.

It is preferred that the or each intermediate part comprises a bend towards the switching member.

In a first preferred embodiment, the resilient means comprise respective springs acting upon the contact prongs of the movable contact member.

More preferably, each spring comprises a compression coil spring.

It is preferred that each spring acts upon the respective contact prong at a position on the same side of the corresponding intermediate part as the fixed end of the movable contact member.

In a second preferred embodiment, the resilient means comprises a lever spring having a fixed end at which it is cantilevered for pivotal movement and a free end divided into prongs acting upon the contact prongs of the movable contact member respectively.

More preferably, the spring is cantilevered by the same support as the movable contact member.

It is preferred that the spring overlaps with the movable contact member in a double layered configuration, having a substantially complementarily shape to lie fittingly against the contact member.

It is preferred that the spring has an overall length in the range from 50% to 100% of that of the movable contact member.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
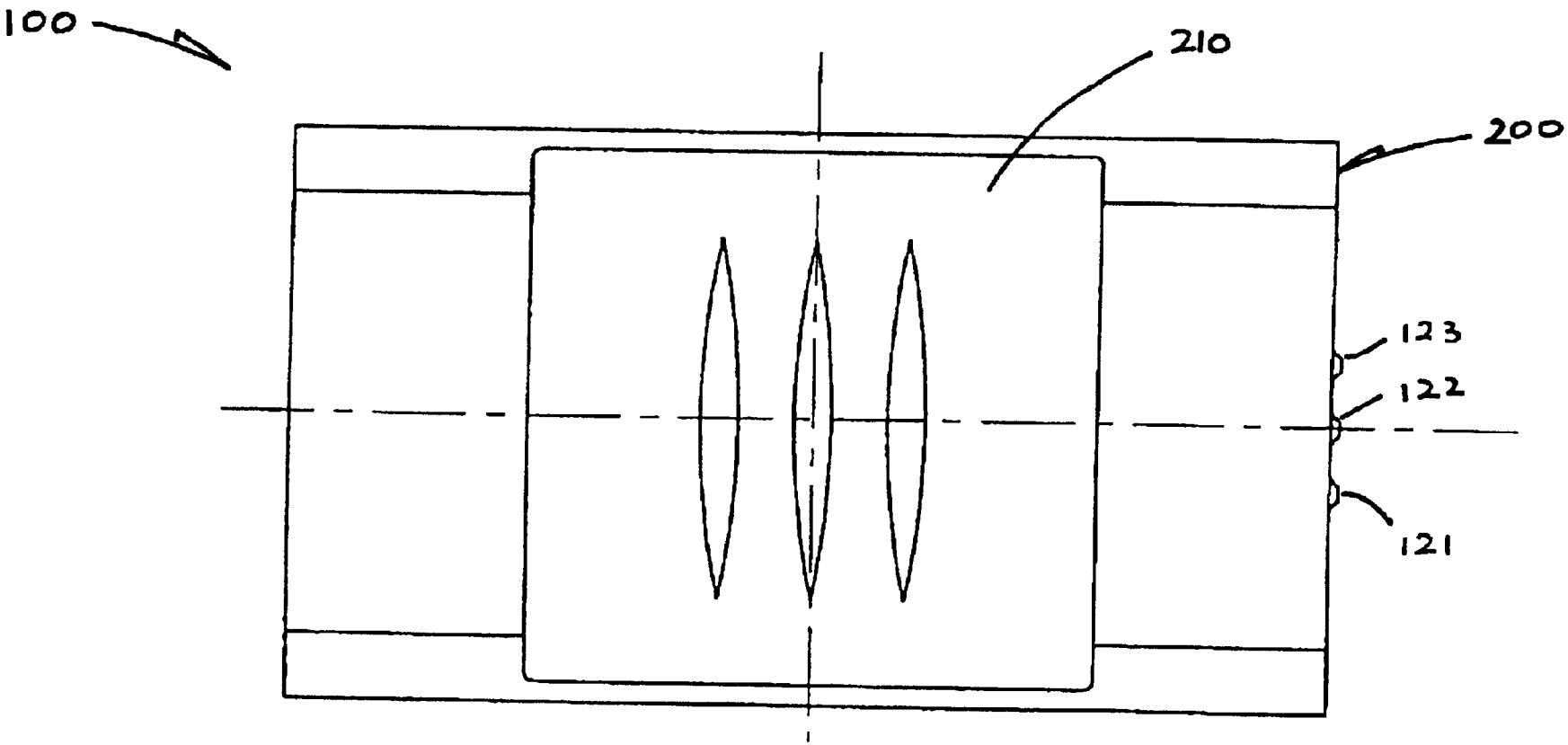
FIG. 1 is a top plan view of a first embodiment of an electrical switch in accordance with the invention.
Figure 2:
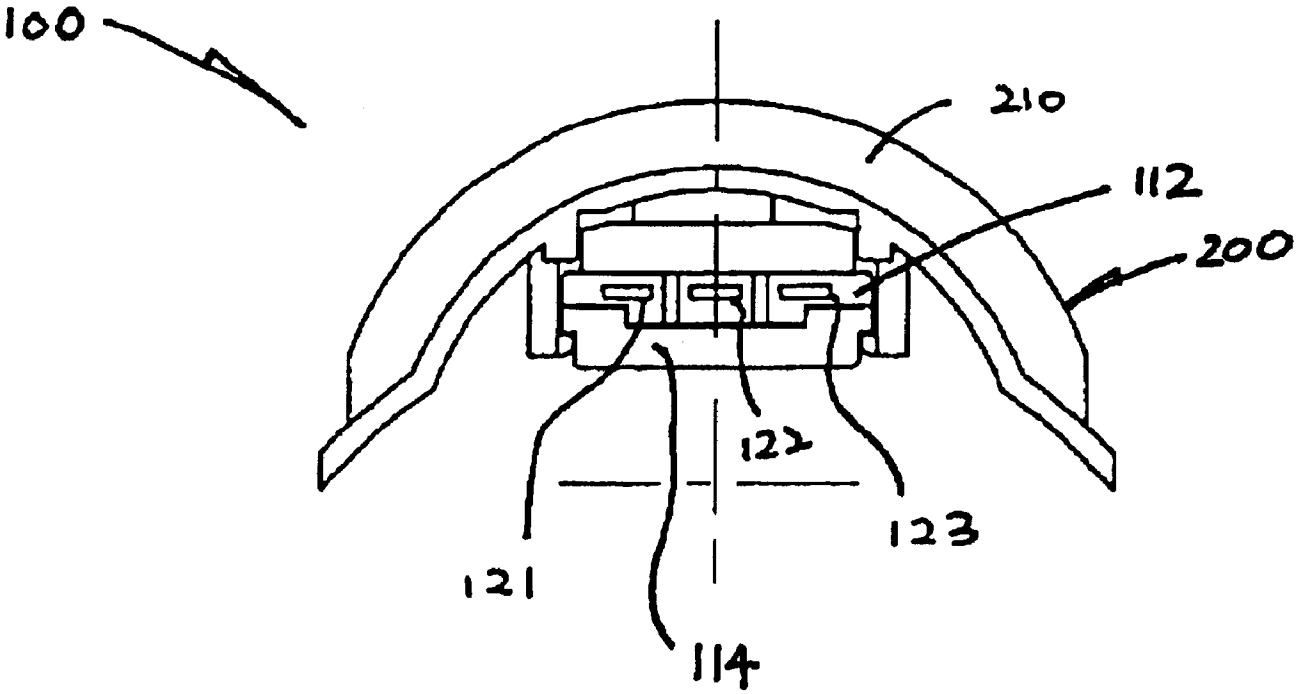
FIG. 2 is an end view of the switch of FIG. 1.
Figure 3:
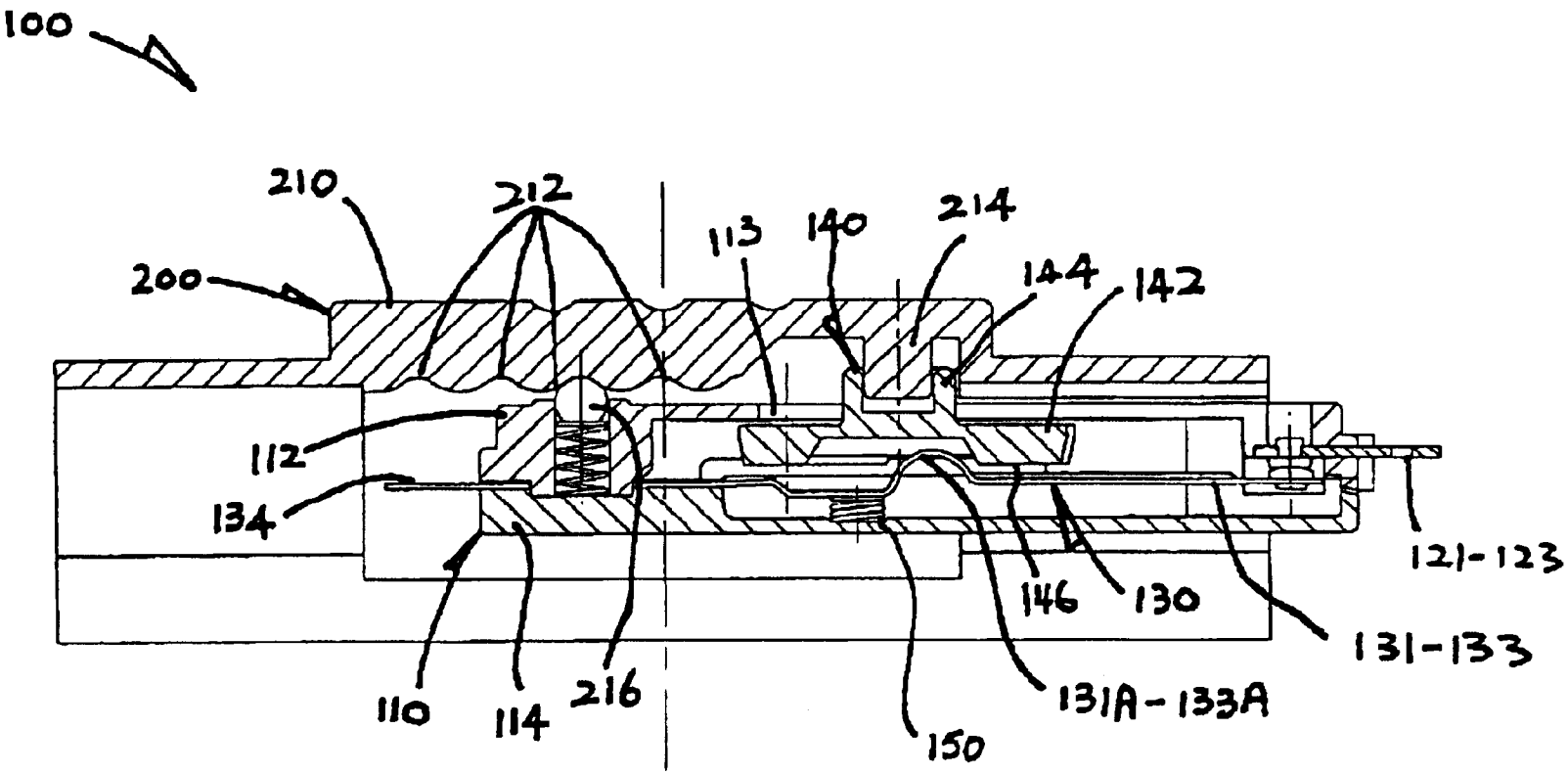
FIG. 3 is a cross-sectional side view of the switch of FIG. 1, said switch being in a switched-on condition.
Figure 4:
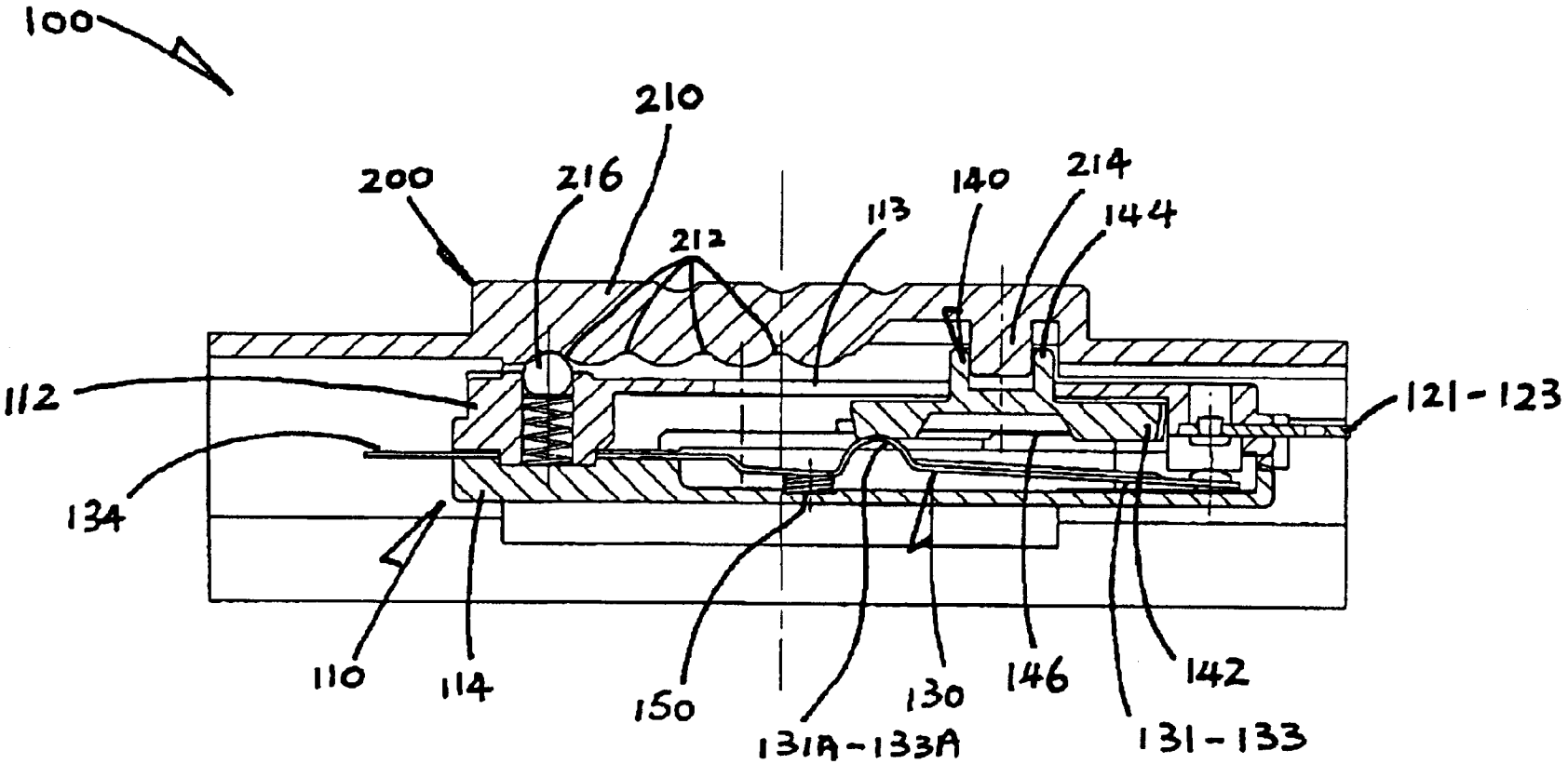
FIG. 4 is a cross-sectional side view corresponding to FIG. 3, showing the switch in a switched-off condition.
Figure 5:
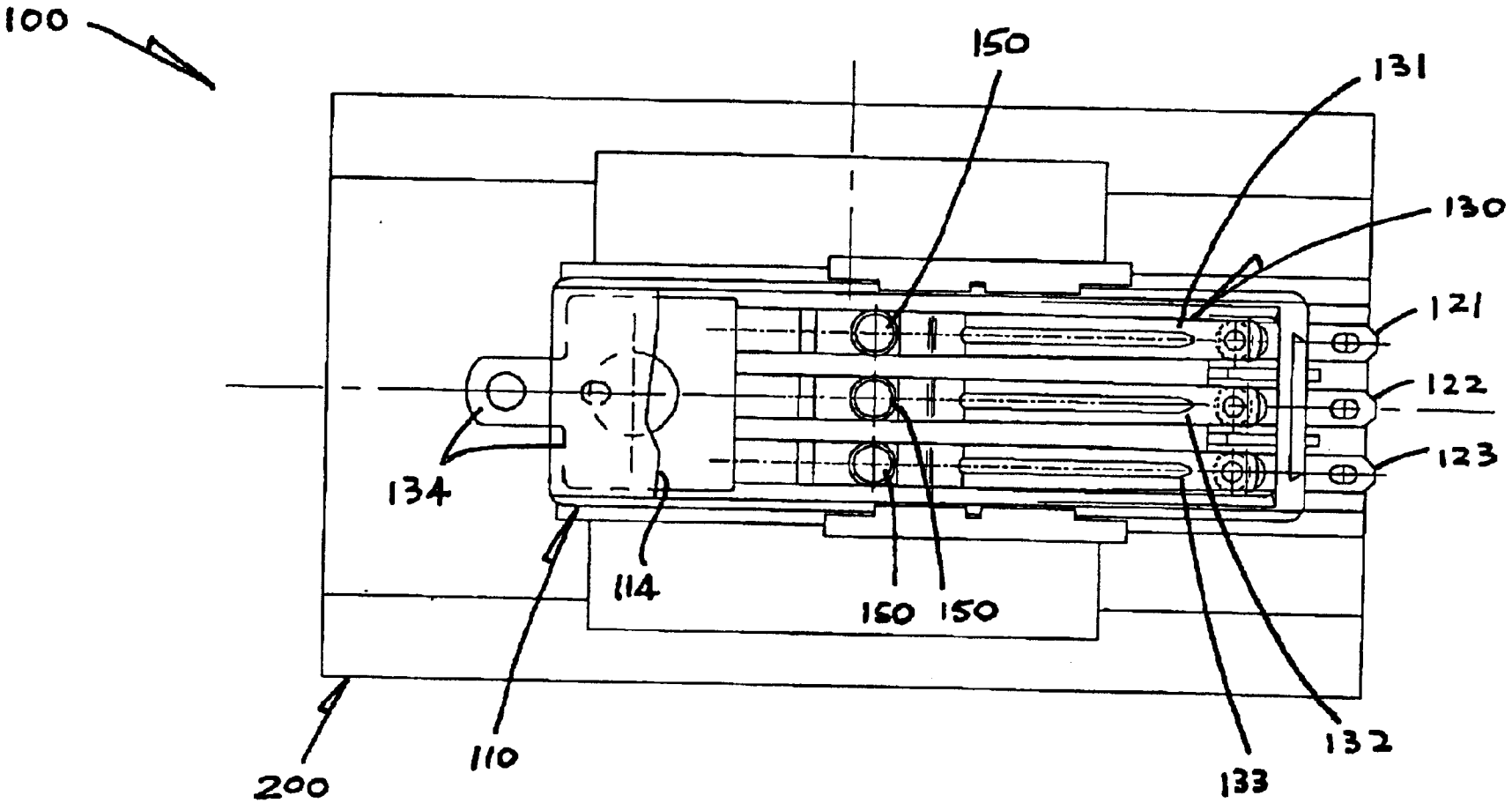
FIG. 5 is a partially broken bottom plan view of the switch of FIG. 1.

Referring initially to FIGS. 1 to 5 of the drawings, there is shown a first electrical switch in the form of a slide switch 100 embodying the invention, which switch 100 has a flat rectangular casing 110 (shown horizontally) and a part-cylindrical cover 200 supported on and extending over the casing 110 for relative sliding movement there along to operate the switch 100. The casing 110 is formed by a pair of upper and lower parts 112 and 114 secured together, and houses therein a series of three co-parallel fixed contacts 121–123, a elongate resiliently deformable movable contact member 130 and a switching member 140. The cover 200 includes an integral knob 210 for gripping by a user to be slid in either direction, thereby moving the switching member 140 and in turn causing the movable contact member 130 to pivot into and out of contact with the fixed contacts 121–123.

The knob 210 is formed, on its inner surface, with a wavy series of four recesses 212 along its left end portion and an integral stud 214 depending from its right end. The upper casing part 112 is provided with an upwardly protruding spring-loaded ball 216 for successive engagement with the recesses 212, thereby defining four predetermined switching positions for the cover 200 relative to the casing 110. The stud 214 is for connecting the switching member 140.

The fixed contacts 121–123 and the movable contact member 130 are located to extend horizontally out from within opposite right and left ends respectively of the casing 110, for connection between a load and a power source. The movable contact member 130 resembles a fork, having a left end 134 and a right end that is trifurcated into a series of three co-parallel contact prongs 131–133. The movable contact member 130 is clamped at its left end 134 between the same ends of the two casing parts 112 and 114, with its contact prongs 131–133 extending to reach below the fixed contacts 121–123 respectively.

The contact prongs 131–133 normally pivot upwards, under the action of their inherent resilience, into contact with the corresponding fixed contacts 121–123. The contact prongs 131–133 are selectively pivotable downwards, against the action of resilience, away from the corresponding fixed contacts 121–123 by means of the switching member 140 in a predetermined manner dictated by the design and position of the switching member 140. The contact prongs 131–133 are formed, at about their mid-lengths, with respective inverted U-shaped bends 131A–133A for acting upon by the switching member 140.

The switching member 140 has a horizontal base plate 142 and an integral tubular boss 144 upstanding therefrom. The boss 144 extends upwardly through a longitudinal slot 113 in the upper casing part 112 and is then jointed with the stud 214 depending from within the knob 210, whereby the cover 200 engages with the switching member 140. Upon manual sliding movement from one predetermined position to another, the cover 200 moves the switching member 140 simultaneously through corresponding positions within the casing 110.

The base plate 142 of the switching member 140 is formed, on its bottom surface, with a predetermined surface profile 146. The profile 146 comprises three co-parallel tracks, which extend parallel to the sliding direction of the switching member 140, for bearing from above against the U-bends 131A–133A to manoeuvre the contact prongs 131–133 individually against their resilience. Each track has a specific combination of relatively downwardly protruding and non-protruding sections along its length, for pushing the respective contact prong 131/132/133 downwardly off the corresponding fixed contact 121/122/123 or allowing the former to pivot upwardly into contact with the latter, respectively.

The relative position of the switching member 140 as slid to by the cover 200 determines one of said protruding or non-protruding sections of each track for acting upon the corresponding contact prong 131/132/133 by its U-bend 131A/132A/133A. Thus, the arrangement of the protruding and non-protruding track sections of the surface profile 146 provides a number of switching combinations as to which one or more of the fixed contacts 121–123 are contacted by the movable contact member 130, according to the relative position of the cover 200 or its knob 210.

As can be understood from above, the movable contact member 130 is supported at one end 134 in a cantilever manner, with the contact prongs 131–133 at the opposite end being pivotable. The switching profile 146 has an extended length to provide the various protruding and non-protruding sections of its tracks for selectively bearing against the U-bends 131A–131C. For this reason, the contact prongs 131–133 must be sufficiently long over opposite front and rear sections of their U-bends 131A–131C to give room for the switching profile 146 to slide.

This gives rise to a potential problem that the contact prongs 131–133 may lose their resilience or become slack after prolonged use, unless they are made of a high grade equally conductive material with long lasting resilience and/or made relatively thicker. Such a material will of course be expensive, and the contact prongs 131–133 will be excessively stiff during initial use if they are thicker than the optimum thickness.

To solve this problem, an additional resilient member is employed to supplement the resilience of the contact prongs 131–133. As one example, the resilient member is in the form of a compression coil spring 150 located between each contact prong 131/132/133 and the base wall of the lower casing part 114. Each spring 150 is positioned immediately next to the corresponding U-bend 131A/132A/133A on the same side as the fixed end 134 of the movable contact member 130.

By reason of the fact that the spring 150 is acting behind the U-bend 131A/132A/133A, the rest of the contact prong 131/132/133 forward of the U-bend 131A/132A/133A remains being supported in a cantilever manner. Although the effective cantilevered length of the movable contact member 130 becomes relatively shorter, the intermediate cantilevering supports, i.e. the springs 150, are in themselves resilient, and therefore the necessary flexibility of the contact prongs 131–133 is maintained.

Figure 6:
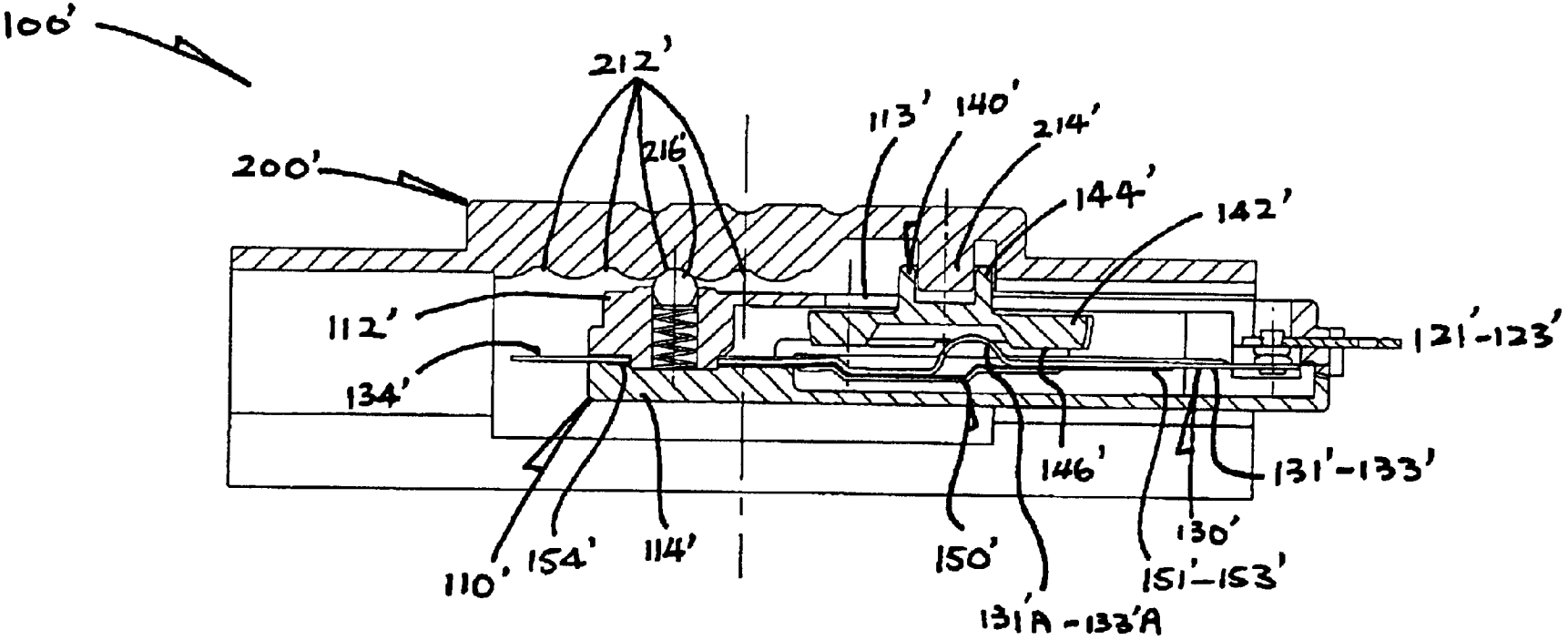
FIG. 6 is a cross-sectional side view of a second embodiment of an electrical switch in accordance with the invention, said switch being in a switched-on condition.
Figure 7:
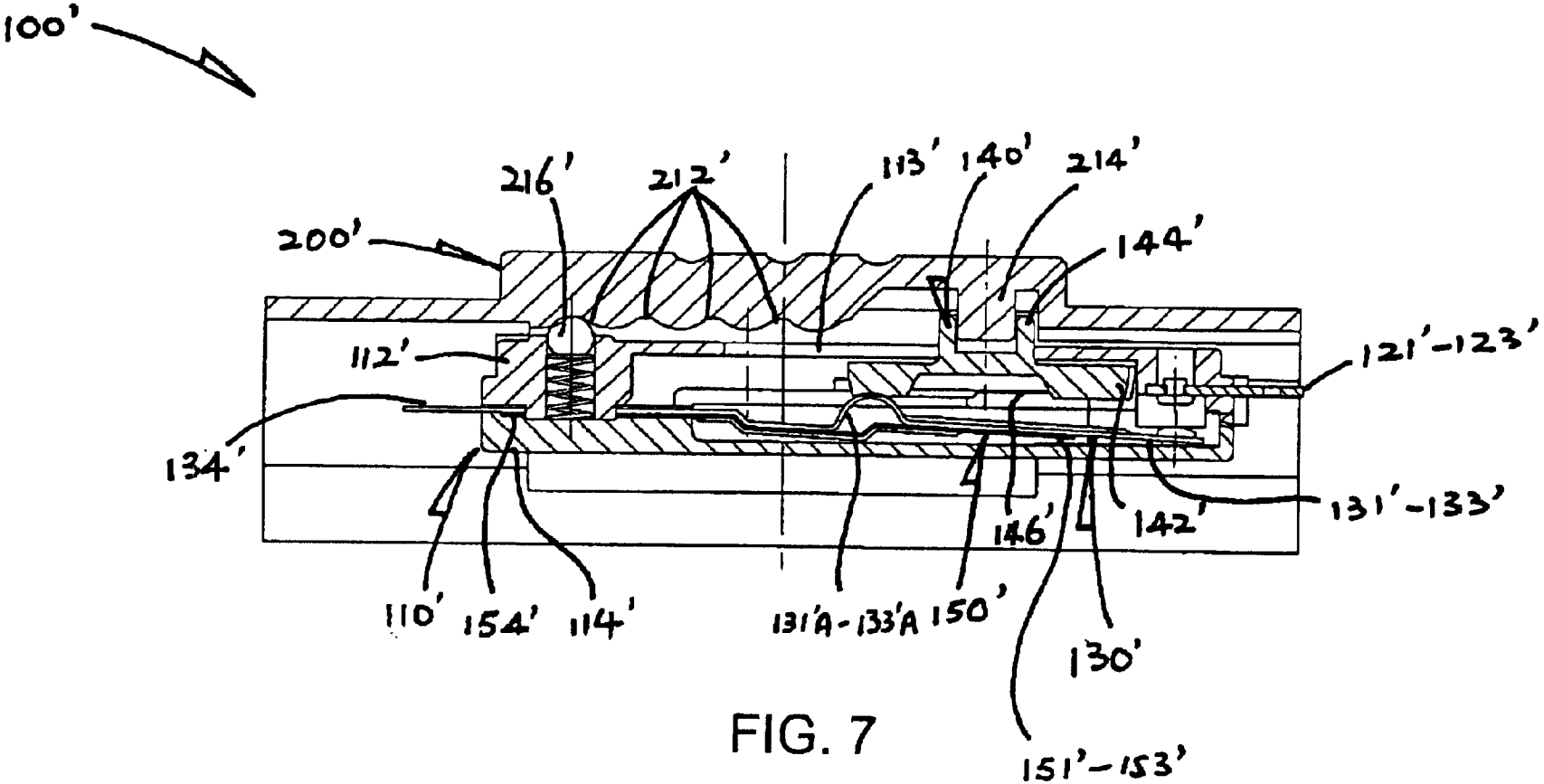
FIG. 7 is a cross-sectional side view corresponding to FIG. 6, showing the switch in a switched-off condition.
Figure 8:
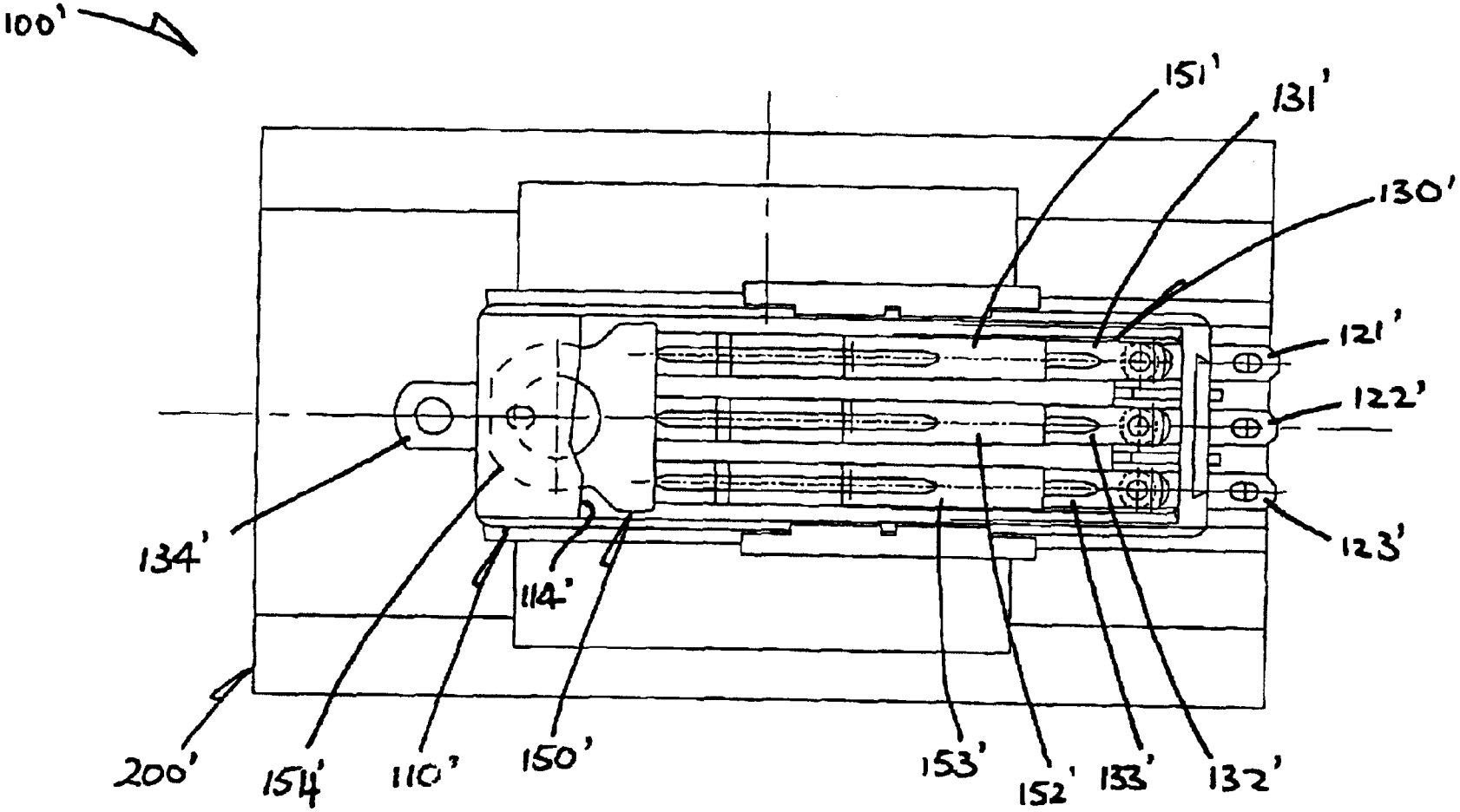
FIG. 8 is a partially broken bottom plan view of the switch of FIG. 6.

Reference is now made to FIGS. 6 to 8 of the drawings, showing a second electrical slide switch 100' embodying the invention, which switch 100' has substantially the same construction as the first switch 100, with equivalent parts designated by the same reference numerals followed by an apostrophe sign. The only major difference lies in the use of another type of the supplementary resilient member that is a lever spring in the form of a fork 150'.

The fork 150' has a left end 154' and a right end that is trifurcated into a series of three co-parallel prongs 151'–153'. The fork 150' is clamped at its left end 154' between the same ends of the two casing parts 112' and 114' as the movable contact member 130', overlapping with the contact member 130' in a double layered configuration. The prongs 151'–153' extend in a parallel manner underneath the corresponding contact prongs 131–133 and bearing resiliently against them from below.

Apart from the absence of U-bends (131A'–133A'), the fork 150' has essentially the same basic design as the movable contact member 130' except that its prongs 151'–153' are relatively shorter than the contact prongs 131–133. This is apparent when viewed from below (FIG. 8), in that the fork 150' is essentially the same as the movable contact member 130' apart from its relatively shorter prongs 151'–153'. In geometry, the overall length of the fork 150' is at least about 50%, and up to 100%, of that of the movable contact member 130'.

The fork 150' is substantially complementarily shaped to lie fittingly against the movable contact member 130' from below, except over the region of the U-bends 131A'–133A' of the latter. Also, as the fork 150' is cantilevered by the same support as the movable contact member 130', both of them are pivotable in the same manner and in union. Insofar as the movable contact member 130' is concerned, there is no shortening in terms of its cantilevered length and the necessary flexibility of its contact prongs 131'–133' is maintained.

In both embodiments, the springs 150 and the fork 150' are made of a metallic material that can be selected simply based on resilience characteristics, without any need to take electrical conductivity into account as they are not for conduction. Thus, a relatively cheaper material can be chosen for use, and there is a relatively wider range of choice.

It is envisaged that the springs 150 can be replaced by individual lever springs which likewise bear against the movable contact prongs 131–133 from below or may be in the form of integral parts protruding downwardly from the contact prongs 131–133 as spring legs.

The invention has been given by way of example only, and various other modifications of and/or alterations to the described embodiments may be made by persons skilled in the art without departing from the scope of the invention as specified in the appended claims.

What is claimed is:

1. An electrical switch comprising a casing, at least two fixed contacts and an elongate resiliently deformable movable contact member in the casing, said contact member having opposite first and second sides, and a switching member supported by the casing in sliding contact on the first side of and with an intermediate part of the contact member to cause the contact member to pivot against its resilience for making and breaking electrical connection with the fixed contact, the contact member including a fixed end at which it is cantilevered for pivotal movement and a free end for contact with the fixed contact, the free end of the contact member being divided into contact prongs arranged to contact with the fixed contacts respectively, wherein a resilient means is provided acting resiliently upon the second side of the contact member to maintain the sliding contact of the contact member with the switching member.

2. The electrical switch as claimed in claim 1, wherein each contact prong includes an individual intermediate part with which the switching member is in sliding contact.

3. The electrical switch as claimed in claim 2, wherein the switching member includes parallel tracks, each having relatively protruding and non-protruding sections along its length, in sliding contact with the intermediate parts of the contact prongs respectively, thereby providing a number of switching combinations between the contact prongs and the fixed contacts according to the relative position of the switching member.

4. The electrical switch as claimed in claim 1, wherein the or each intermediate part comprises a bend towards the switching member.

5. The electrical switch as claimed in claim 1, wherein the resilient means comprise respective springs acting upon the contact prongs of the movable contact member.

6. The electrical switch as claimed in claim 5, wherein each spring comprises a compression coil spring.

7. The electrical switch as claimed in claim 5, wherein each spring acts upon the respective contact prong at a position on the same side of the corresponding intermediate part as the fixed end of the movable contact member.

8. The electrical switch as claimed in claim 1, wherein the resilient means comprises a lever spring having a fixed end at which it is cantilevered for pivotal movement and a free end divided into prongs acting upon the contact prongs of the movable contact member respectively.

9. The electrical switch as claimed in claim 8, wherein the spring is cantilevered by the same support as the movable contact member.

10. The electrical switch as claimed in claim 8, wherein the spring overlaps with the movable contact member in a double layered configuration, having a substantially complementarily shape to lie fittingly against the contact member.

11. The electrical switch as claimed in claim 8, wherein the spring has an overall length in the range from 50% to 100% of that of the movable contact member.

* * * * *